US011326282B2

(12) United States Patent
Liu et al.

(10) Patent No.: US 11,326,282 B2
(45) Date of Patent: May 10, 2022

(54) WEAR-RESISTANT MULTIFUNCTIONAL ROPE

(71) Applicant: ROPENET GROUP CO., LTD., Tai'an (CN)

(72) Inventors: Ruiqiang Liu, Tai'an (CN); Yanping Qiu, Tai'an (CN); Runxi Jiang, Nanjing (CN); Ming Shen, Tai'an (CN); Longfeng Zuo, Tai'an (CN)

(73) Assignee: Ropenet Group Co., Ltd., Tai'an (CN)

( * ) Notice: Subject to any disclaimer, the term of this patent is extended or adjusted under 35 U.S.C. 154(b) by 0 days.

(21) Appl. No.: 17/088,408

(22) Filed: Nov. 3, 2020

(65) Prior Publication Data

US 2021/0130994 A1 May 6, 2021

(30) Foreign Application Priority Data

Nov. 5, 2019 (CN) ..... 201911072634.7

(51) Int. Cl.

| | |
|---|---|
| ***D04C 1/12*** | (2006.01) |
| ***D04C 1/02*** | (2006.01) |
| ***D07B 1/04*** | (2006.01) |
| ***A63B 29/02*** | (2006.01) |

(52) U.S. Cl.

CPC ..... *D04C 1/12* (2013.01); *A63B 29/02* (2013.01); *D04C 1/02* (2013.01); *D07B 1/04* (2013.01); *D10B 2321/0211* (2013.01); *D10B 2331/02* (2013.01)

(58) Field of Classification Search

CPC .. D04C 1/02; D04C 1/12; A63B 29/02; A63B 29/028; D07B 1/04

See application file for complete search history.

(56) References Cited

U.S. PATENT DOCUMENTS

| | | | | |
|---|---|---|---|---|
| 4,321,854 A * | 3/1982 | Foote | ..... | D07B 1/145 87/6 |
| 4,534,262 A * | 8/1985 | Swenson | ..... | D07B 1/025 87/6 |
| 4,640,178 A | 2/1987 | Kurzbock | | |

(Continued)

FOREIGN PATENT DOCUMENTS

| | | |
|---|---|---|
| CN | 105755871 A | 7/2016 |
| CN | 106012621 B | 5/2017 |

(Continued)

OTHER PUBLICATIONS

Steven B. Warner, Fiber Science, Prentice Hall, p. 126 (Year: 1995).*

*Primary Examiner* — Shaun R Hurley

(74) *Attorney, Agent, or Firm* — Faegre Drinker Biddle & Reath LLP

(57) ABSTRACT

Disclosed are embodiments of rope designs and making and manufacturing of such ropes. In some embodiments, a rope comprises a set of first rope cores, each first rope core of the set of first rope cores comprising a first material; a set of second rope cores, each second rope core of the set of second rope cores comprising a second material, the second material being different from the first material; and a rope sheath configured to encompass the set of first rope cores and the second rope core. In some cases, the rope sheath is braided from a plurality of rope sheath strands.

14 Claims, 8 Drawing Sheets

(56) References Cited

U.S. PATENT DOCUMENTS

| | | | | |
|---|---|---|---|---|
| 4,640,179 | A * | 2/1987 | Cameron | D04C 1/02 87/6 |
| 5,060,549 | A * | 10/1991 | Beal | A63B 29/028 87/6 |
| 6,050,077 | A | 4/2000 | Mueller | |
| 7,047,860 | B2 | 5/2006 | Faborsky | |
| 7,703,372 | B1 * | 4/2010 | Shakespeare | A63B 29/028 87/6 |
| 8,136,438 | B2 * | 3/2012 | Shakespeare | A63B 29/028 87/6 |
| 8,485,081 | B2 * | 7/2013 | Kim | D07B 1/025 87/6 |
| 8,978,532 | B2 | 3/2015 | Canedo Duarte da Rocha et al. | |
| 2005/0192581 | A1 * | 9/2005 | Molz | D04C 1/12 606/74 |
| 2015/0128792 | A1 * | 5/2015 | Zachariades | D07B 1/04 87/6 |
| 2020/0277715 | A1 * | 9/2020 | Kusu | D04C 1/12 |

FOREIGN PATENT DOCUMENTS

| | | | |
|---|---|---|---|
| CN | 107083706 | A | 8/2017 |
| CN | 106906568 | B | 1/2019 |
| CN | 106638067 | B | 5/2019 |
| CN | 110184834 | A | 8/2019 |
| CN | 110359302 | A | 10/2019 |
| CN | 110396839 | A | 11/2019 |
| CN | 110438832 | A | 11/2019 |
| CN | 210596792 | U | 5/2020 |
| CN | 210766145 | U | 6/2020 |

* cited by examiner

WEAR-RESISTANT MULTIFUNCTIONAL ROPE

CROSS-REFERENCES TO RELATED APPLICATIONS

This application claims priority to Chinese Patent Application No. 201911072634.7, filed Nov. 5, 2019, incorporated by reference herein for all purposes.

TECHNICAL FIELD

The present disclosure relates to designs of ropes and the process of making such ropes.

BACKGROUND

Ropes are often used in various activities, constructions, and explorations such as, for example, caverns, river tracing, firefighting, rescue, resource exploration, oil exploration. There are generally two types of ropes, static ropes and dynamic ropes. Static ropes have relatively low extensibilities/elongations, which can provide stable supports. Dynamic ropes have relatively high extensibilities/elongations, which can absorb impact force in rapid movements.

SUMMARY

Ropes are often rubbing other objections, such as rocks, bricks, grounds, and may become breakable. Wear resistance is an important quality factor of ropes. Additionally, when the rope is broken, the rebound force can cause injury to the user. At least some embodiments of the present disclosure are directed to a rope having a rope sheath that is wear-resistant. At least some embodiments of the present disclosure are directed to a rope having two types of rope cores, with a first type of rope core designed to provide the function of a static rope in providing supports and a second type of core designed to provide the function of a dynamic rope to absorb some impact force. In some embodiments, the second type of rope core has more extensibility than the first type of rope core. Additionally, in some embodiments, the rope is designed to have a relatively light weight while meeting certain performance requirements by for example, fiber selections, used twisting technologies, and used weaving technologies, and/or other relevant technologies.

As recited in examples, Example 1 is a rope. The rope comprises a set of first rope cores, each first rope core of the set of first rope cores comprising a first material; a set of second rope cores, each second rope core of the set of second rope cores comprising a second material, the second material being different from the first material; and a rope sheath configured to encompass the set of first rope cores and the second rope core, the rope sheath being braided from a plurality of rope sheath strands.

Example 2 is the rope of Example 1, wherein the rope sheath is braided using at least thirty rope sheath strands.

Example 3 is the rope of Example 1 or 2, wherein the rope sheath is braided using forty rope sheath strands.

Example 4 is the rope of any one of Examples 1-3, wherein the set of first rope cores has a lower extensibility than the set of second rope cores.

Example 5 is the rope of any one of Examples 1-4, wherein the set of first rope cores has a breaking strength between seven kilonewtons and eleven kilonewtons.

Example 6 is the rope of any one of Examples 1-5, wherein the first material comprises at least one of a polyethylene fiber, a liquid-crystal polymer fiber, an aramid fiber, a carbon fiber, a ceramic fiber, a metallic fiber, and a glass fiber.

Example 7 is the rope of any one of Examples 1-6, wherein the set of second rope cores has an extensibility of at least 50% at break.

Example 8 is the rope of any one of Examples 1-7, wherein the second material comprises at least one of a nylon fiber and a composite fiber comprising a polyamide fiber.

Example 9 is the rope of any one of Examples 1-8, wherein the rope sheath comprises a first section of rope sheath and a second section of rope sheath, wherein the first section of rope sheath has a first weaving pitch, wherein the second section of rope sheath has a second weaving pitch different from the first weaving pitch.

Example 10 is the rope of Example 9, wherein the first weaving pitch is smaller than the second weaving pitch.

Example 11 is the rope of any one of Examples 1-10, wherein the rope sheath comprises a third material, wherein the third material has a higher extensibility than the first material.

Example 12 is the rope of any one of Examples 1-11, wherein each first rope core of the set of first rope cores comprises a plurality of first strands.

Example 13 is the rope of Example 12, wherein the plurality of first strands are twisted.

Example 14 is the rope of any one of Examples 1-13, wherein each second rope core of the set of second rope cores comprises a plurality of second strands.

Example 15 is the rope of Example 14, wherein the plurality of second strands are twisted.

Example 16 is the rope of any one of Examples 1-15, wherein the set of first rope cores has a first extensibility less than 10% at break.

Example 17 is the rope of any one of Examples 1-16, wherein the set of first rope cores is made with an initial twist process in a first twisting direction and a re-twist process in a second twisting direction, the second twisting direction being opposite to the first twisting direction.

Example 18 is the rope of any one of Examples 1-17, wherein the set of first rope cores are disposed approximate to a center of the rope.

Example 19 is the rope of any one of Examples 1-18, where in the set of second rope cores are disposed surrounding the set of first rope cores.

Example 20 is the rope of any one of Examples 1-19, wherein the set of second rope cores is made with an initial twist process in a third twisting direction and a re-twist process in a fourth twisting direction, the fourth twisting direction being opposite to the third twisting direction.

Example 21 is a rope. The rope comprises a set of first rope cores, each first rope core of the set of first rope cores comprising a first material; a set of second rope cores, each second rope core of the set of second rope cores comprising a second material, the second material being different from the first material; a rope sheath configured to encompass the set of first rope cores and the second rope core; and a plurality of states comprising a first state and a second state; wherein the rope has an elongation property smaller than a predetermined elongation threshold when the rope is in the first state, and wherein the elongation property is equal to or greater than the predetermined elongation threshold when the rope is in the second state.

Example 22 is the rope of Example 21, wherein the predetermined elongation threshold comprises a static elongation threshold of 2%.

Example 23 is the rope of Example 21 or 22, wherein the predetermined elongation threshold comprises an elongation at break of 40%.

Example 24 is the rope of any one of Examples 21-, wherein the set of first rope cores has a first elongation less than 10% at break.

Example 25 is the rope of any one of Examples 21-24, wherein the set of second rope cores has a second elongation greater than 20% at break.

Example 26 is the rope of any one of Examples 21-25, wherein none of the set of first rope cores is broken in the first state.

Example 27 is the rope of any one of Examples 21-26, wherein at least one first rope core of the set of first rope cores is broken in the second state.

Example 28 is the rope of any one of Examples 21-27, wherein the set of first rope cores has a breaking strength between seven kilonewtons and eleven kilonewtons.

Example 29 is the rope of any one of Examples 21-28, wherein the first material comprises at least one of a polyethylene fiber, a liquid-crystal polymer fiber, an aramid fiber, a carbon fiber, a ceramic fiber, a metallic fiber, and a glass fiber.

Example 30 is the rope of any one of Examples 21-29, wherein the second material comprises a nylon fiber and a composite fiber comprising polyamide fiber.

Example 31 is the rope of any one of Examples 21-30, wherein the rope sheath comprises a first section of rope sheath and a second section of rope sheath, wherein the first section of rope sheath has a first weaving pitch, wherein the second section of rope sheath has a second weaving pitch different from the first weaving pitch.

Example 32 is the rope of Example 31, wherein the first weaving pitch is smaller than the second weaving pitch.

Example 33 is the rope of any one of Examples 21-32, wherein the rope sheath comprises a third material, wherein the third material has a higher extensibility than the first material.

Example 34 is the rope of any one of Examples 21-33, wherein each first rope core of the set of first rope cores comprises a plurality of first strands.

Example 35 is the rope of Example 34, wherein the plurality of first strands are twisted.

Example 36 is the rope of any one of Examples 21-35, wherein each second rope core of the set of second rope cores comprises a plurality of second strands.

Example 37 is the rope of Example 36, wherein the plurality of second strands are twisted.

Example 38 is the rope of any one of Examples 21-37, wherein the set of first rope cores is made with an initial twist process in a first twisting direction and a re-twist process in a second twisting direction, the second twisting direction being opposite to the first twisting direction.

Example 39 is the rope of any one of Examples 21-38, where in the set of second rope cores are disposed surrounding the set of first rope cores.

Example 40 is the rope of any one of Examples 21-39, wherein the set of second rope cores is made with an initial twist process in a third twisting direction and a re-twist process in a fourth twisting direction, the fourth twisting direction being opposite to the third twisting direction.

Example 41 is a method of making a rope. The method includes the steps of: selecting first fibers, the first fibers having a static elongation lower than 5%; selecting second fibers, the second fibers having a static elongation greater than 5%; selecting third fibers, the third fibers having a static elongation greater than 5%; twisting the first fibers into initial first strands; re-twisting the initial first fiber strands into first fiber strands; twisting the second fibers into initial second strands; re-twisting the initial second strands into second fiber strands; twisting the third fibers into rope sheath strands; conducting a first heat setting to the first fiber strands at a first temperature with a force applied; conducting a second heat setting to the second fiber strands at a second temperature, the second temperature being different from the first temperature; and weaving the rope sheath strands into a rope sheath encompassing the first fiber strands and the second fiber strands to form a rope.

Example 42 is the method of Example 41, wherein weaving the rope sheath strands comprises weaving the rope sheath strands at a first pitch for a first section and weaving the rope sheath strands at a second pitch for a second section, and wherein the first pitch is different from the second pitch.

Example 43 is the method of Example 42, wherein the first pitch is smaller than the second pitch.

Example 44 is the method of Example 42, wherein the first pitch is in the range of twenty (20) millimeters to thirty-five (35) millimeters.

Example 45 is the method of Example 42, wherein the second pitch is in the range of twenty-eight (28) millimeters to forty (40) millimeters.

Example 46 is the method of any one of Examples 41-45, wherein weaving the rope sheath strands comprises weaving the rope sheath in forty-knit plain weave.

Example 47 is the method of any one of Examples 41-46, wherein weaving the rope sheath strands comprises weaving the rope sheath in forty-knit twill weave.

Example 48 is the method of any one of Examples 41-47, wherein the third fibers are same as the second fibers.

Example 49 is the method of any one of Examples 41-48, wherein the first temperature is in the range of seventy (70) degree Celsius to one hundred and eighty (180) degree Celsius.

Example 50 is the method of any one of Examples 41-49, wherein the second temperature is in the range of eighty (80) degree Celsius to one hundred and eighty (180) degree Celsius.

Example 51 is the method of any one of Examples 41-50, wherein the first heat setting has a first duration and the second heat setting has a second duration, wherein the second duration is longer than the first duration.

Example 52 is the method of Example 51, wherein the first duration is in the range of five (5) minutes to ten (10) minutes.

Example 53 is the method of Example 51, wherein the second duration is in the range of thirty (30) minutes to one hundred and fifty (150) minutes.

Example 54 is the method of any one of Examples 41-53, wherein each of the heat-set first fiber strands has a first elongation less than ten percent (10%) at break.

Example 55 is the method of any one of Examples 41-54, wherein each of the heat-set second fiber strands has a second elongation greater than fifty (50%) at break.

Example 56 is the method of any one of Examples 41-55, wherein the first fibers comprise at least one of a polyethylene fiber, a liquid-crystal polymer fiber, an aramid fiber, a carbon fiber, a ceramic fiber, a metallic fiber, and a glass fiber.

Example 57 is the method of any one of Examples 41-56, wherein the second fibers comprise at least one of a nylon fiber and a composite fiber comprising polyamide fiber.

Example 58 is the method of any one of Examples 41-57, wherein the third fibers comprise at least one of a nylon fiber and a composite fiber comprising polyamide fiber.

Example 59 is the method of any one of Examples 41-58, further comprising:

conducting a third heat setting to the rope sheath strands at a third temperature.

Example 60 is the method of Example 59, wherein the third temperature is in the range of eighty (80) degree Celsius to one hundred and eighty (180) degree Celsius.

BRIEF DESCRIPTION OF THE DRAWINGS

The accompanying drawings are incorporated in and constitute a part of this specification and, together with the description, explain the features and principles of the disclosed embodiments. In the drawings.

DETAILED DESCRIPTION

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Although illustrative methods may be represented by one or more drawings (e.g., flow diagrams, communication flows, etc.), the drawings should not be interpreted as implying any requirement of, or particular order among or between, various steps disclosed herein. However, certain some embodiments may require certain steps and/or certain orders between certain steps, as may be explicitly described herein and/or as may be understood from the nature of the steps themselves (e.g., the performance of some steps may depend on the outcome of a previous step). Additionally, a "set," "subset," or "group" of items (e.g., inputs, algorithms, data values, etc.) may include one or more items, and, similarly, a subset or subgroup of items may include one or more items. A "plurality" means more than one.

As used herein, the term "based on" is not meant to be restrictive, but rather indicates that a determination, identification, prediction, calculation, and/or the like, is performed by using, at least, the term following "based on" as an input. For example, predicting an outcome based on a particular piece of information may additionally, or alternatively, base the same determination on another piece of information.

Figure 1A:
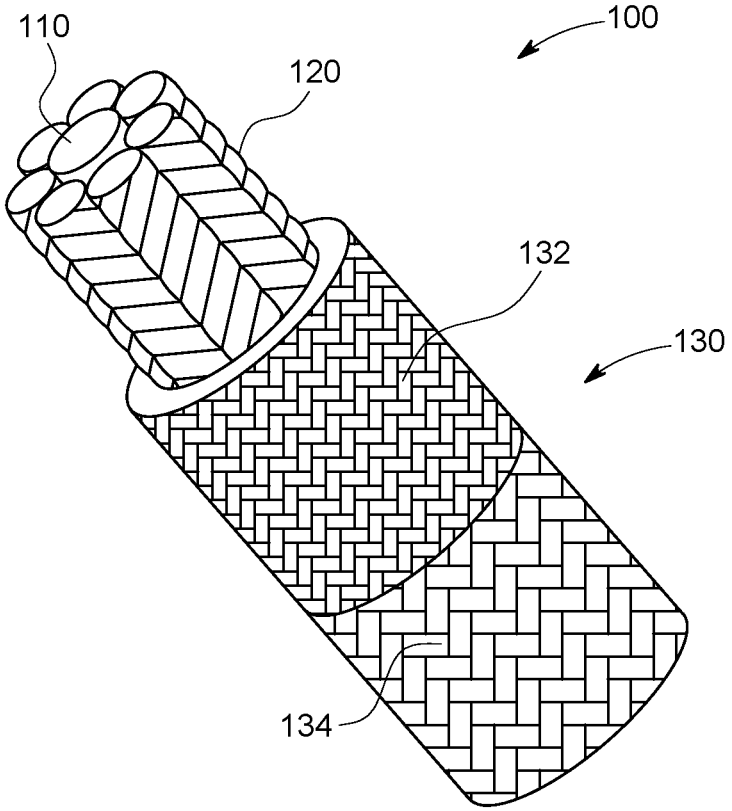
FIG. 1A depicts a structural diagram of an illustrative example of a wear-resistant multifunctional rope, in accordance with certain embodiments of the present disclosure.
Figure 1B:
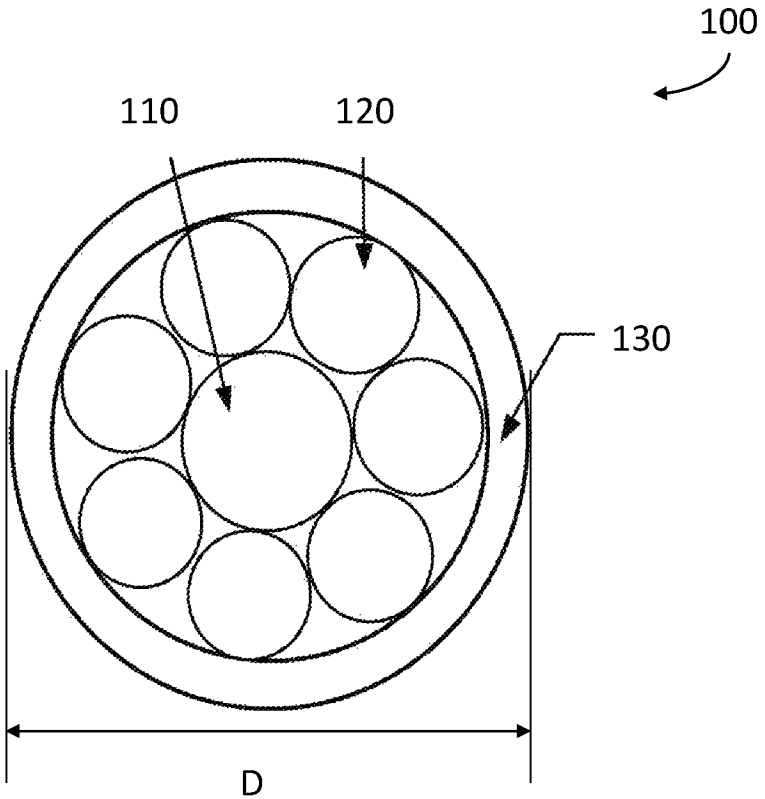
FIG. 1B depicts a cross-sectional view of the example wear-resistant multifunctional rope illustrated in FIG. 1A, in accordance with certain embodiments of the present disclosure.

FIG. 1A depicts a perspective view of an illustrative example of a wear-resistant multifunctional rope 100, in accordance with certain embodiments of the present disclosure. FIG. 1B depicts a cross-sectional view of the example wear-resistant multifunctional rope 100 illustrated in FIG. 1A, in accordance with certain embodiments of the present disclosure. As illustrated, the rope 100 includes a set of first rope cores 110, a set of second rope cores 120, and a rope sheath 130 configured to encompass the set of first rope cores 110 and the second rope core 120. In one example, the set of first rope cores 110 includes a single first rope core. In another example, the set of first rope cores 110 includes a plurality of first rope cores.

In some embodiments, the set of first rope cores 110 is designed to have a selected collective breaking strength, where the selected breaking strength can be selected based on by its usage. In some embodiments, the set of first rope cores 110 are designed to provide the functions of a static rope. A static rope is a low-elongation rope when placed under loads. In one embodiment, the set of first rope cores 110 has a breaking strength between seven (7) kilonewtons and eleven (11) kilonewtons. As used herein, the breaking strength of an object or a material is the maximum amount of tensile stress that the object/material can withstand before breaking into two or more parts. In another embodiment, the set of first rope cores 110 has breaking strength between seven (7) kilonewtons and eight (8) kilonewtons. In one embodiment, the set of first rope cores 110 has breaking strength between eight (8) kilonewtons and nine (9) kilonewtons. In another embodiment, the set of first rope cores 110 has breaking strength between nine (9) kilonewtons and ten (10) kilonewtons. In one embodiment, the set of first rope cores 110 has breaking strength between ten (10) kilonewtons and eight (8) kilonewtons.

As used herein, an extensibility of an object refers to the extension of the object being stretched under a tensile force from its original state. In some cases, extensibility is also referred to as elongation. In some cases, an extensibility is determined based on an original length of an object and a stretched length when the object is under a tensile force. In some cases, the extensibility can be determined by the differences between the stretched length and the original length divided by the original length. For example, an extensibility of a rope can be 2%.

In some embodiments, the extensibility of an object can be measured under various conditions, for example, when the object is static, when the object is in movement, when the object is under a tensile force, when the object is at break (i.e., when the object is being separated into two or more parts), and/or the like. In some embodiments, the set of first rope cores 110 have an extensibility (i.e., elongation) less than 10% at break. In some cases, the set of first rope cores 110 have an extensibility (i.e., elongation) less than 5% at break. In some cases, the set of first rope cores 110 have an extensibility (i.e., elongation) less than 2% at break.

In some embodiments, each first rope core 110 comprises a first material. In some embodiments, the first material comprises polyethylene fiber, liquid-crystal polymer fiber, aramid fiber, carbon fiber, ceramic fiber, metallic fiber, glass fiber and/or a combination thereof. In some examples, the first material has a linear density, or referred to as a specification, in the range of 420 Denier (i.e., 0.000111 g/m) to 1680 Denier. In some cases, each first rope core 110 comprises a plurality of first strands. In some embodiments, the linear density of the first rope core 110 is around 4 gram/meter. In some cases, the plurality of first strands are twisted, in S-direction, Z-direction, or a combination thereof. As used herein, an S-direction twist, or referred to as an S twist, and a Z-direction twist, or referred to as a Z twist, refer to two types of twists in opposite directions (i.e., an S-direction twist being opposite to a Z-direction twist).

In some cases, the plurality of first strands are weaved, or referred to as braided. In one example, the plurality of first strands include eight (8) first strands, for example, which are braided together. In another example, the plurality of first strands include twelve (12) first strands, for example, which are braided together. In yet another example, the plurality of first strands include sixteen (16) first strands, for example, which are braided together. In yet another example, the plurality of first strands include twenty-four (24) first strands, for example, which are braided together. In some designs, the set of first rope cores 110 are disposed approximate to a center of the rope 100.

In some embodiments, the first rope cores 110 are made with an initial twist process to form initial first strands and a re-twist process to form first strands. In some cases, the initial twist process has a twist angle in the range of 120 twist/meter to 190 twist/meter. In some cases, the re-twist process has a twist angle in the range of 80 twist/meter to 140 twist/meter. In one example, the initial twist process uses three (3) fibers to form one initial first strand. In one example, the re-twist process uses three (3) initial first strands to form one first strand.

In some embodiments, the set of second rope cores 120 are disposed surrounding the set of first rope cores 110. In some embodiments, the set of second rope cores 120 is designed to have a selected collective breaking strength, where the selected breaking strength can be selected based on its usage. In some embodiments, the set of second rope cores 120 are designed to provide the functions of a dynamic rope. A dynamic rope is a high-elongation rope when placed under loads and designed to absorb impacts. In one embodiment, the set of second rope cores 120 has a breaking strength higher than twelve (12) kilonewtons. In one embodiment, the set of second rope cores 120 has a breaking strength higher than thirteen (13) kilonewtons. In one embodiment, the set of second rope cores 120 has a breaking strength higher than ten (10) kilonewtons. In one embodiment, the set of second rope cores 120 has a breaking strength higher than fifteen (15) kilonewtons.

In some embodiments, the set of second rope cores 120 have a higher extensibility than the extensibility of the set of first rope cores 110. In some cases, the extensibility of the set of second rope cores 120 at break is greater than 150% of the extensibility of the set of first rope cores 110 at break. In some cases, the extensibility of the set of second rope cores 120 at break is equal to or greater than two (2) times of the extensibility of the set of first rope cores 110 at break. In some embodiments, the set of second rope cores 120 have an extensibility (i.e., elongation) greater than 20% at break. In some cases, the set of second rope cores 120 have an extensibility (i.e., elongation) greater than 30% at break. In some cases, the set of second rope cores 120 have an extensibility (i.e., elongation) greater than 40% at break. In some cases, the set of second rope cores 120 have an extensibility (i.e., elongation) greater than 50% at break. In some cases, the set of second rope cores 120 have an extensibility (i.e., elongation) greater than 90% at break. In some cases, the set of second rope cores 120 have a static extensibility (i.e., elongation) greater than 3%. A static elongation/extensibility refers to the extensibility (i.e., elongation) measured under an eighty (80) kilograms load. In some cases, the set of second rope cores 120 has a static extensibility (i.e., static elongation) greater than 5%. In some cases, the set of second rope cores 120 have a dynamic extensibility (i.e., elongation) greater than 20%. A dynamic extensibility (i.e., dynamic elongation) refers to the extensibility (i.e., elongation) measured in a standard fall, for example, the drop test specified in Mountaineering equipment—Dynamic mountaineering ropes—Safety requirements and test methods, BSI Standards Institution 2012, which is incorporated by reference in its entirety.

In some embodiments, each second rope core 120 comprises a second material. In some cases, the second material is different from the first material. In some embodiments, the second material comprises at least one of nylon fiber and composite fiber comprising polyamide fiber. In some cases, the second material is a composite fiber including polyamide fibers and the first material. In some designs, the second material is a composite fiber including polyamide fibers and the first material in a 4:1 ratio. In some examples, the first material has a specification in the range of 420 Denier to 1680 Denier. In some embodiments, the linear density of the second rope core 120 is in the range of 2.8 gram/meter to 3.2 gram/meter. In some cases, each second rope core 120 comprises a plurality of second strands. In some cases, the plurality of second strands are twisted, for example, in S-directions, Z-directions, or a combination thereof. In some cases, the plurality of second strands are weaved. In one example, the plurality of second strands include eight (8) second strands. In another example, the plurality of second strands include twelve (12) second strands. In yet another example, the plurality of second strands include sixteen (16) second strands. In yet another example, the plurality of second strands include twenty-four (24) second strands. In some cases, the set of second rope cores are evenly distributed in a circle. In some cases, the set of second rope cores are evenly distributed in an enclosed shape.

In some embodiments, the second rope cores 120 are made with an initial twist process to form initial second strands and a re-twist process to form the second strands. In some cases, the initial twist process has a twist angle in the range of 120 twist/meter to 190 twist/meter. In some cases, the re-twist process has a twist angle in the range of 80 twist/meter to 140 twist/meter. In one example, the initial twist process uses three (3) fibers to form one initial second strand. In one example, the re-twist process uses three (3) initial first strands to form one second strand.

In some cases, the rope sheath 130 is weaved, or referred to as braided, from a plurality of rope sheath strands. In some cases, the number of rope sheath strands is more than the number of first strands to form each first rope core in the set of first rope cores 110. In some cases, the number of rope sheath strands is more than the number of second strands to form each second rope core in the set of second rope cores 120. In some cases, the rope sheath 130 is weaved using at least thirty rope sheath strands. In some cases, the rope sheath 130 is weaved using forty rope sheath strands. In some cases, the rope sheath 130 is weaved using thirty-two skin strands. In some cases, the rope sheath 130 is weaved using forty-eight skin strands. In some cases, the plurality of rope sheath strands are twisted, for example, in Z-direction, S-direction, and a combination thereof. In some cases, the plurality of rope sheath strands include equal numbers of Z-direction twisted strands and S-direction twisted strands (e.g., 20 Z-direction twisted strands and 20 S-direction twisted strands).

In some embodiments, the rope sheath 130 comprises a third material, where the third material has a higher extensibility than the first material. In some cases, the third material is the same as the second material. In some embodiments, the third material includes, for example, a nylon fiber, a composite fiber, a composite fiber having polyamide fiber, and/or the like, and a combination thereof. In some embodiments, the rope sheath 130 includes a first section of rope sheath 132 and a second section of rope sheath 134. In some cases, the first section of rope sheath 132 has a first weaving pitch, and the second section of rope sheath 134 has a second weaving pitch different from the first weaving pitch. In some cases, the first weaving pitch is smaller than the second weaving pitch. In one example, the first weaving pitch is in the range of twenty (20) millimeters to thirty-five (35) millimeters. In one example, the second weaving pitch is in the range of twenty-eight (28) millimeters to forty (40) millimeters.

In some embodiments, the third material can be used in a specification in the range of 5×420 Denier to 3×2000 Denier. In some cases, the rope sheath strands can be made using a twist process having a twist angle in the range of eight (80) twist/meter to one-hundred and eighty (180) twist/meter. In some cases, the rope sheath 130 can be made using a weaving configuration, for example, forty-strand plain weave, forty-strand twill weave, and a combination thereof. In some cases, the rope sheath 130 can be made using a weaving configuration, for example, thirty-two-strand plain weave, thirty-two-strand twill weave, and a combination thereof. In some cases, the rope sheath 130 can be made using a weaving configuration, for example, forty-eight-strand plain weave, forty-eight-strand twill weave, and a combination thereof.

In some embodiments, the rope 100 has a diameter D small than fifteen (15) millimeters. In some cases, the rope 100 has a diameter D smaller than twelve (12) millimeters. In some cases, the rope 100 has a diameter D smaller than eleven (11) millimeters. In some cases, the rope 100 has a diameter D smaller than ten (10) millimeters. In some cases, the rope 100 has a diameter D smaller than nine (9) millimeters. In some cases, the rope 100 has a diameter D smaller than eight (8) millimeters. In some embodiments, the rope 100 has a diameter D between nine (9) millimeters and eleven (11) millimeters. In some embodiments, the ropes 100 has a diameter D between ten (10) millimeters and eleven (11) millimeters. In one example, the linear density of the rope 100 is less than seventy (70) gram/meter. In one example, the linear density of the rope 100 is less than sixty-five (65) gram/meter. In one embodiment, the linear density of the rope 100 is less than fifty-five (55) gram/meter. In one embodiment, the linear density of the rope 100 is less than fifty (50) gram/meter.

In some embodiments, the rope 100 having the rope sheath 130 using forty-stand weave configuration has a dimension D smaller than both the dimension of the rope 100 having the rope sheath 130 using thirty-two-stand weave configuration and having the rope sheath 130 using forty-eight-stand weave configuration. In some embodiments, the rope 100 having the rope sheath 130 using forty-stand weave configuration has a dimension D being smaller than both the dimension of the rope 100 having the rope sheath 130 using thirty-two-stand weave configuration and having the rope sheath 130 using forty-eight-stand weave configuration by 0.1 millimeters to 0.3 millimeters.

In some embodiments, the rope 100 having the rope sheath 130 using forty-stand weave configuration has a weight per meter lighter than both the dimension of the rope 100 having the rope sheath 130 using thirty-two-stand weave configuration and having the rope sheath 130 using forty-eight-stand weave configuration. In some embodiments, the rope 100 having the rope sheath 130 using forty-stand weave configuration has a weight per meter lighter than both the dimension of the rope 100 having the rope sheath 130 using thirty-two-stand weave configuration and having the rope sheath 130 using forty-eight-stand weave configuration by 0.8 gram/meter to 3.3 gram/meter.

In some embodiments, the rope 100 having the rope sheath 130 using forty-stand weave configuration has a better wear-resistance than both the dimension of the rope 100 having the rope sheath 130 using thirty-two-stand weave configuration and having the rope sheath 130 using forty-eight-stand weave configuration. In some embodiments, the rope 100 having the rope sheath 130 using forty-stand weave configuration has a better wear-resistance than both the dimension of the rope 100 having the rope sheath 130 using thirty-two-stand weave configuration and having the rope sheath 130 using forty-eight-stand weave configuration by 12% to 14%.

In some embodiments, the rope sheath 130, the first rope cores 110 and/or the second rope cores 120 are subject to a specific heat setting treatment respectively, for example, to improve the energy absorption and buffering capacity. As used herein, heat setting describes a thermal process for treating textile products, which may take place in either a steam environment or a dry heat environment. In some embodiments, the first rope cores 110 are subject to a force in the heat setting treatment, for example, to reduce extensibility and have a higher breaking strength.

In some embodiments, the rope 100 has a plurality of states, for example, a first state and a second state. In some embodiments, the first state is a static state, where the rope 100 is used as a static rope. In some embodiments, the second state is a dynamic state, where the rope 100 is used as a dynamic rope. In some cases, the rope 100 has an elongation property smaller than a predetermined elongation threshold when the rope 100 is in a first state, and the elongation property is equal to or greater than the predetermined elongation threshold when the rope is in a second state. In some cases, the predetermined elongation threshold is a static elongation threshold of 5%. In some cases, the predetermined elongation threshold is a static elongation threshold of 8%. In some cases, the predetermined elongation threshold is an elongation of 40% at break. In some cases, none of the set of first rope cores 110 is broken in the first state. In some cases, at least one of the set of first rope cores 110 is broken in the second state.

In one example, when the rope 100 is in the second state, the rope 100 can take falls more than eight (8) times, with a shrinkage rate less than 4.5%, a slip rate between the rope cores and the rope sheath less than 0.2%, a static elongation rate less than 9.5%, a first dynamic elongation rate less than 38%, a knotability ratio less than 1.1, and a first fall impact force less than 8.2 kilonewtons. As used herein, a first dynamic elongation rate (i.e., extensibility) refers the extensibility (i.e., elongation or elongation rate) at a first dynamic movement. In one example, when the rope 100 is in the first state, the rope 100 can take falls more than ten (10) times, with a slip rate between the rope cores and the rope sheath less than 0.5%, with a shrinkage rate less than 5%, a static elongation rate less than 3.5%, a knotability ratio less than 1.5, a breaking strength greater than twenty-five (25) kilonewtons, and a knotting breaking strength greater than 15 kilonewtons.

Figure 2A:
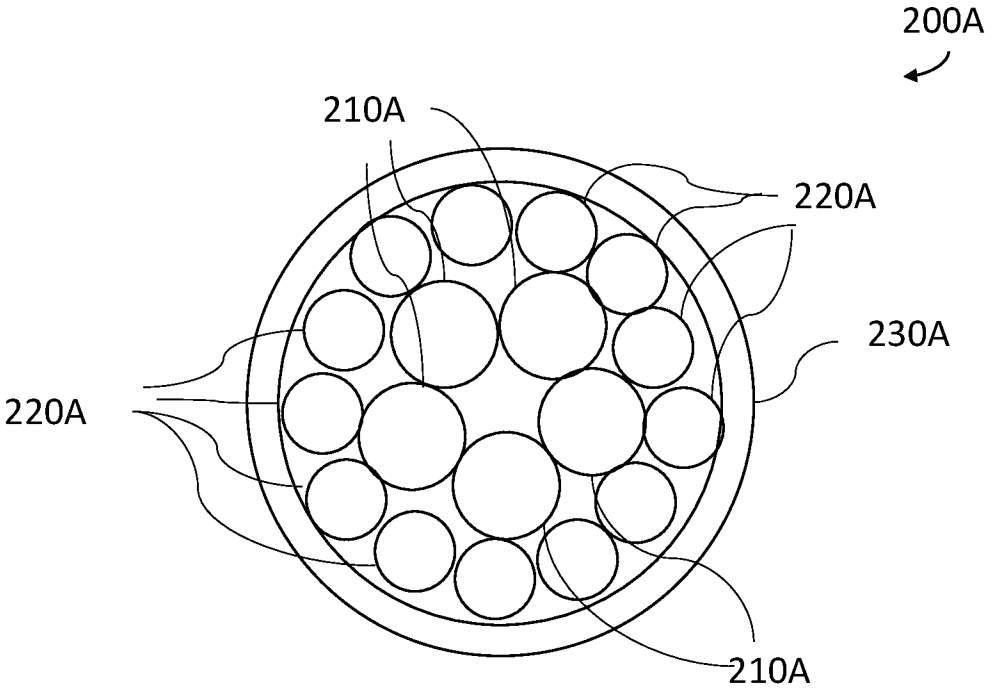
FIGS. 2A-2C depict illustrative examples of a multifunctional ropes, in accordance with certain embodiments of the present disclosure.
Figure 2B:
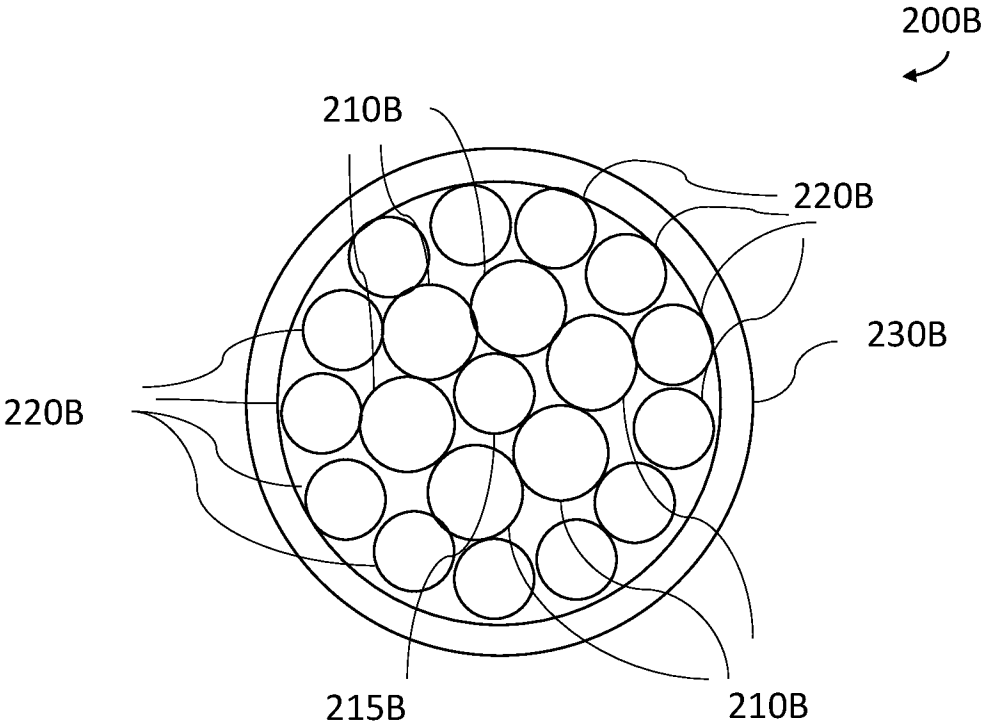
Figure 2C:
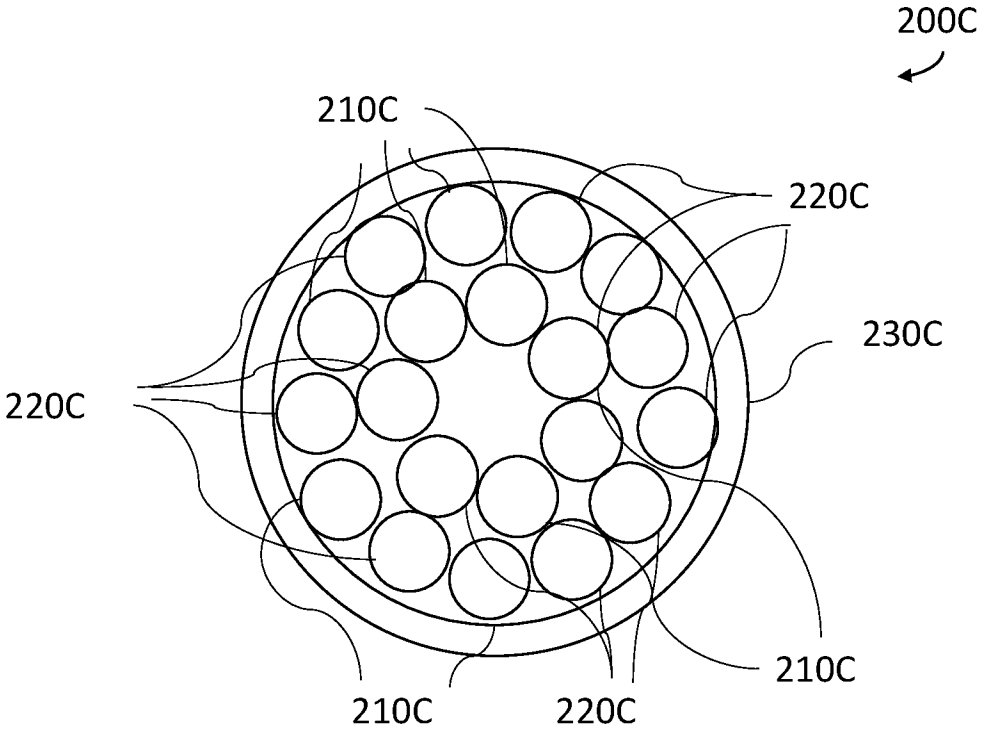

FIGS. 2A-2C depict illustrative examples of designs and arrangements of a multifunctional rope having a set of first rope cores and a set of second rope cores, in accordance with certain embodiments of the present disclosure. FIG. 2A depicts a cross-sectional view of an example of a rope 200A, in accordance with certain embodiments of the present disclosure. In the example illustrated in FIG. 2A, the rope 200A comprises a set of first rope cores 210A, a set of second rope cores 220A, and a rope sheath 230A encompassing the set of first rope cores 210A and the set of second rope cores 220A. In some cases, the set of first rope cores 210A are arranged in a circle.

The set of first rope cores 210A can use any one of the embodiments of rope cores described herein. In some embodiments, the set of first rope cores 210A is designed to have a selected breaking strength, where the selected breaking strength can be selected based on its usage. In some embodiments, the set of first rope cores 210A are designed to provide the functions of a static rope. In one embodiment, the set of first rope cores 210A has a breaking strength between seven kilonewtons and eleven kilonewtons. In some cases, the breaking strength is selected based on statistic data of personal injuries in a rapid movement (e.g., a quick fall). In some embodiments, the set of first rope cores 210A have an extensibility/elongation less than 10% at break. In some cases, the set of first rope cores 210A have an extensibility/elongation less than 5% at break. In some designs, the set of first rope cores 210A have an extensibility/elongation less than 3% at break.

In some embodiments, each first rope core 210A comprises a first material. In some embodiments, the first material comprises at least one of polyethylene fiber, liquid-crystal polymer fiber, aramid fiber, carbon fiber, ceramic fiber, metallic fiber, and glass fiber. In some cases, each first rope core 210A comprises a plurality of first strands. In some cases, the plurality of first strands are twisted. In some cases, the plurality of first strands are braided. In some designs, the set of first rope cores 210A are disposed proximate to a center of the rope.

The set of second rope cores 220A can use any one of the embodiments of rope cores described herein. In some embodiments, the set of second rope cores 220A are disposed surrounding the set of first rope cores 210A. In some embodiments, the set of second rope cores 220A is designed to have a selected breaking strength, where the selected breaking strength can be selected based on its usage. In some embodiments, the set of second rope cores 220A are designed to provide the functions of a dynamic rope. In one embodiment, the set of second rope cores 220A has breaking strength higher than twelve kilonewtons.

In some embodiments, the set of second rope cores 220A have a higher extensibility than the extensibility of the set of first rope cores 210A. In some cases, the extensibility of the set of second rope cores 220A at break is greater than 150% of the extensibility of the set of first rope cores at break. In some cases, the extensibility of the set of second rope cores 220A at break is greater than two times of the extensibility of the set of first rope cores 210A at break. In some embodiments, the set of second rope cores have an extensibility/elongation greater than 20% at break. In some cases, the set of second rope cores 220A have an extensibility/elongation greater than 30% at break. In some cases, the set of second rope cores 220A have an extensibility/elongation greater than 40% at break. In some cases, the set of second rope cores 220A have an extensibility/elongation greater than 50% at break. In some cases, the set of second rope cores 220A have an extensibility/elongation greater than 90% at break. In some cases, the set of second rope cores 220A have a static extensibility/elongation greater than 3%. In some cases, the set of second rope cores 220A has a static extensibility/elongation greater than 5%. In some cases, the set of second rope cores 220A have a dynamic elongation greater than 20%.

In some embodiments, each second rope core 220A comprises a second material. In some cases, the second material is different from the first material. In some embodiments, the second material comprises a nylon fiber, a composite fiber, a composite fiber comprising polyamide fiber, and/or the like, and a combination thereof. In some cases, each second rope core 220A comprises a plurality of second strands. In some cases, the plurality of second strands are twisted. In some cases, the plurality of second strands are braided. In some cases, the set of second rope cores 220A are distributed in a circle. In some cases, the set of second rope cores 220A are distributed in an enclosed shape.

FIG. 2B depicts a cross-sectional view of an example of a rope 200B, in accordance with certain embodiments of the present disclosure. In the example illustrated in FIG. 2B, the rope 200B comprises a set of first rope cores 210B, a set of second rope cores 220B, a set of third cores 215B, and a rope sheath 230B encompassing the set of first rope cores 210B, the set of second rope cores 220B and the set of third rope cores 215B. In some cases, the set of first rope cores 210B are arranged in a circle.

The set of first rope cores 210B can use any one of the embodiments of rope cores described herein. In some embodiments, the set of first rope cores 210B is designed to have a selected breaking strength, where the selected breaking strength can be selected based on its usage. In some embodiments, the set of first rope cores 210B are designed to provide the functions of a static rope. In one embodiment, the set of first rope cores 210B has a breaking strength between seven kilonewtons and eleven kilonewtons. In some cases, the breaking strength is selected based on statistic data of personal injuries in a rapid movement (e.g., a quick fall). In some embodiments, the set of first rope cores 210B have an extensibility/elongation less than 10% at break. In some cases, the set of first rope cores 210B have an extensibility/elongation less than 5% at break. In some designs, the set of first rope cores 210B have an extensibility/elongation less than 3% at break.

In some embodiments, each first rope core 210B comprises a first material. In some embodiments, the first material comprises at least one of polyethylene fiber, liquid-crystal polymer fiber, aramid fiber, carbon fiber, ceramic fiber, metallic fiber, and glass fiber. In some cases, each first rope core 210B comprises a plurality of first strands. In some cases, the plurality of first strands are twisted.

The set of second rope cores 220B can use any one of the embodiments of rope cores described herein. In some embodiments, the set of second rope cores 220B are disposed surrounding the set of first rope cores 210B. In some embodiments, the set of second rope cores 220B is designed to have a selected breaking strength, where the selected breaking strength can be selected based on its usage. In some embodiments, the set of second rope cores 220B are designed to provide the functions of a dynamic rope. In one embodiment, the set of second rope cores 220B has breaking strength higher than twelve kilonewtons.

In some embodiments, the set of second rope cores 220B have a higher extensibility than the extensibility of the set of first rope cores 210B. In some cases, the extensibility of the set of second rope cores 220B at break is greater than 150% of the extensibility of the set of first rope cores at break. In some cases, the extensibility of the set of second rope cores 220B at break is greater than two times of the extensibility of the set of first rope cores 210B at break. In some embodiments, the set of second rope cores have an extensibility/elongation greater than 20% at break. In some cases, the set of second rope cores 220B have an extensibility/elongation greater than 30% at break. In some cases, the set of second rope cores 220B have an extensibility/elongation greater than 40% at break. In some cases, the set of second rope cores 220B have an extensibility/elongation greater than 50% at break. In some cases, the set of second rope cores 220B have an extensibility/elongation greater than 90% at break. In some cases, the set of second rope cores 220B have a static extensibility/elongation greater than 3%. In some cases, the set of second rope cores 220B has a static extensibility/elongation greater than 5%. In some cases, the set of second rope cores 220B have a dynamic elongation greater than 20%.

In some embodiments, each second rope core 220B comprises a second material. In some cases, the second material is different from the first material. In some embodiments, the second material comprises a nylon fiber, a composite fiber, a composite fiber comprising polyamide fiber, and/or the like, and a combination thereof. In some cases, each second rope core 220B comprises a plurality of second strands. In some cases, the plurality of second strands are twisted. In some cases, the plurality of second strands are braided. In some cases, the set of second rope cores 220B are distributed in a circle. In some cases, the set of second rope cores 220B are distributed in an enclosed shape.

In some cases, the rope 200B can include a set of third rope cores 215B. The set of third rope cores 215B can use any one of the embodiments of rope cores described herein. The set of third rope cores 215B comprises a third material. In some cases, the third material is different from the first material. In some cases, the third material is different from the second material. In some cases, each third rope core 215B comprises a plurality of third strands. In some cases, the plurality of third strands are twisted. In some cases, the plurality of third strands are braided. In some cases, the set of third rope cores 215B has a collective breaking strength between the collective breaking strength of the set of first rope cores 210B and the collective breaking strength of the set of second rope cores 220B. In some cases, the set of third rope cores 215B has a static elongation between the static elongation of the set of first rope cores 210B and the static elongation of the set of second rope cores 220B. In some cases, the set of third rope cores 215B has an elongation at break between the elongation at break of the set of first rope cores 210B and the elongation at break of the set of second rope cores 220B.

FIG. 2C depicts a cross-sectional view of an example of a rope 200C, in accordance with certain embodiments of the present disclosure. In the example illustrated in FIG. 2C, the rope 200C comprises a set of first rope cores 210C, a set of second rope cores 220C, and a rope sheath 230C encompassing the set of first rope cores 210C and the set of second rope cores 220C. In some cases, the set of first rope cores 210C and the set of second rope cores are arranged in a mixed pattern. For example, a first rope core 210C is adjacent to a second rope core 220C in a circle arrangement.

The set of first rope cores 210C can use any one of the embodiments of rope cores described herein. In some embodiments, the set of first rope cores 210C is designed to have a selected breaking strength, where the selected breaking strength can be selected based on its usage. In some embodiments, the set of first rope cores 210C are designed to provide the functions of a static rope. In one embodiment, the set of first rope cores 210C has a breaking strength between seven kilonewtons and eleven kilonewtons. In some cases, the breaking strength is selected based on statistic data of personal injuries in a rapid movement (e.g., a quick fall). In some embodiments, the set of first rope cores 210C have an extensibility/elongation less than 10% at break. In some cases, the set of first rope cores 210C have an extensibility/elongation less than 5% at break. In some designs, the set of first rope cores 210C have an extensibility/elongation less than 3% at break.

In some embodiments, each first rope core 210C comprises a first material. In some embodiments, the first material comprises at least one of polyethylene fiber, liquid-crystal polymer fiber, aramid fiber, carbon fiber, ceramic fiber, metallic fiber, and glass fiber. In some cases, each first rope core 210C comprises a plurality of first strands. In some cases, the plurality of first strands are twisted. In some cases, the plurality of first strands are braided. In some designs, the set of first rope cores 210C are disposed proximate to a center of the rope.

The set of second rope cores 220C can use any one of the embodiments of rope cores described herein. In some embodiments, the set of second rope cores 220C is designed to have a selected breaking strength, where the selected breaking strength can be selected based on its usage. In some embodiments, the set of second rope cores 220C are designed to provide the functions of a dynamic rope. In one embodiment, the set of second rope cores 220C has breaking strength higher than twelve kilonewtons.

In some embodiments, the set of second rope cores 220C have a higher extensibility than the extensibility of the set of first rope cores 210C. In some cases, the extensibility of the set of second rope cores 220C at break is greater than 150% of the extensibility of the set of first rope cores at break. In some cases, the extensibility of the set of second rope cores 220C at break is greater than two times of the extensibility of the set of first rope cores 210C at break. In some embodiments, the set of second rope cores have an extensibility/elongation greater than 20% at break. In some cases, the set of second rope cores 220C have an extensibility/elongation greater than 30% at break. In some cases, the set of second rope cores 220C have an extensibility/elongation greater than 40% at break. In some cases, the set of second rope cores 220C have an extensibility/elongation greater than 50% at break. In some cases, the set of second rope cores 220C have an extensibility/elongation greater than 90% at break. In some cases, the set of second rope cores 220C have a static extensibility/elongation greater than 3%. In some cases, the set of second rope cores 220C has a static extensibility/elongation greater than 5%. In some cases, the set of second rope cores 220C have a dynamic elongation greater than 20%.

In some embodiments, each second rope core 220C comprises a second material. In some cases, the second material is different from the first material. In some embodiments, the second material comprises a nylon fiber, a composite fiber, a composite fiber comprising polyamide fiber, and/or the like, and a combination thereof. In some cases, each second rope core 220C comprises a plurality of second strands. In some cases, the plurality of second strands are twisted. In some cases, the plurality of second strands are braided. In some cases, the set of first rope cores 210C and the set of second rope cores 220C are collectively distributed in a plurality of circles. In some cases, the set of first rope cores 210C and the set of second rope cores 220C are collectively distributed in an enclosed shape.

Figure 3A:
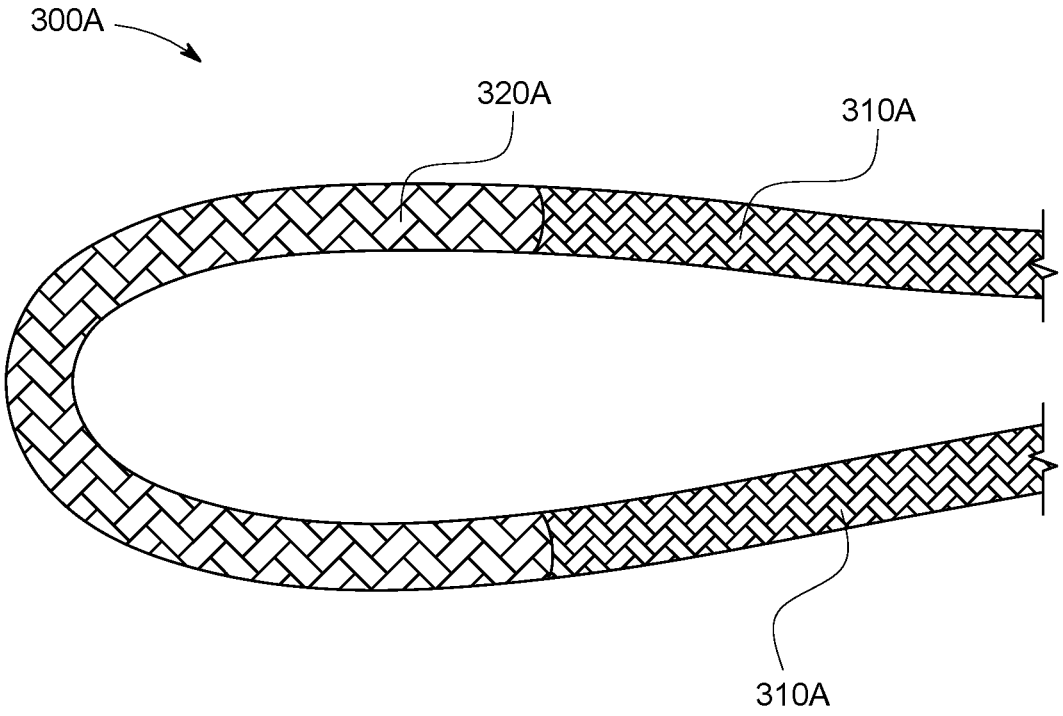
FIGS. 3A-3B depict illustrative examples of rope sheath designs, in accordance with certain embodiments of the present disclosure.
Figure 3B:
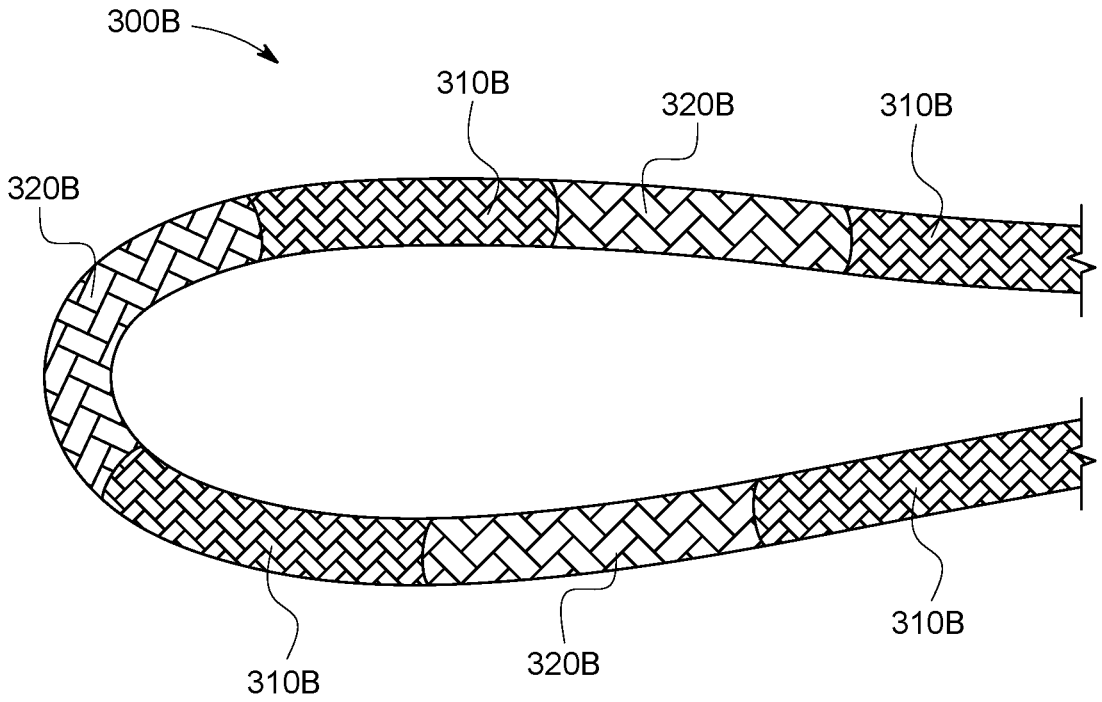

FIGS. 3A-3B depict illustrative examples of rope sheath designs, in accordance with certain embodiments of the present disclosure. In one example illustrated in FIG. 3A, the rope 300A has first rope sheath section(s) 310A and second rope sheath section(s) 320A. In some embodiments, the first rope sheath section 310A has a first weaving pitch, and the second rope sheath section 320A has a second weaving pitch different from the first weaving pitch. In some cases, the first weaving pitch is smaller than the second weaving pitch. In one example, the first weaving pitch is in the range of twenty (20) millimeters to thirty-five (35) millimeters. In one example, the second weaving pitch is in the range of twenty-eight (28) millimeters to forty (40) millimeters. In some cases, the first rope sheath section 310A has better wear resistant property than the second rope sheath section 320A. In this example, the first rope sheath sections 310A are disposed at two ends of the rope 300A.

In one example illustrated in FIG. 3B, the rope 300B has first rope sheath section(s) 310B and second rope sheath section(s) 320B. In some embodiments, the first rope sheath section 310B has a first weaving pitch, and the second rope sheath section 320B has a second weaving pitch different from the first weaving pitch. In some cases, the first weaving pitch is smaller than the second weaving pitch. In one example, the first weaving pitch is in the range of twenty (20) millimeters to thirty-five (35) millimeters. In one example, the second weaving pitch is in the range of twenty-eight (28) millimeters to forty (40) millimeters. In some cases, the first rope sheath section 310B has better wear resistant property than the second rope sheath section 320B. In this example, the first rope sheath sections 310B and the second rope sheath sections 320B are arranged in a mixed pattern. In some cases, a first rope sheath section 310B is adjacent to two second rope sheath sections 320B. In some cases, a second rope sheath section 320B is adjacent to two first rope sheath sections 310B.

Figure 4:
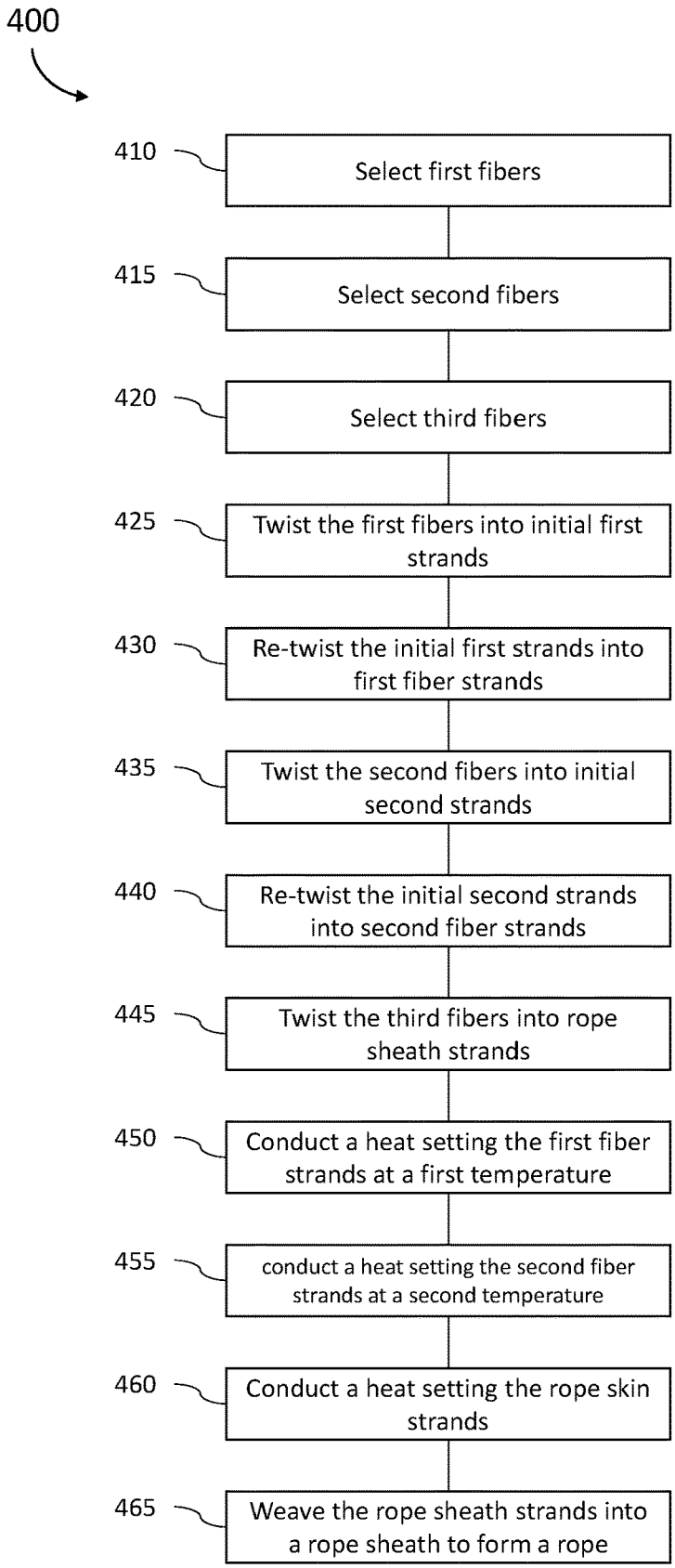
FIG. 4 depicts an illustrative process of making a wear-resistant multifunctional rope, in accordance with certain embodiments of the present disclosure.

FIG. 4 depicts one illustrative process of making a wear-resistant multifunctional rope, in accordance with certain embodiments of the present disclosure. One or more steps of process 400 are optional and/or can be modified by one or more steps of other embodiments described herein. Additionally, one or more steps of other embodiments described herein may be added to the process 400. Initially, the process 400 includes selecting first fibers (410). In some cases, the first fibers have a static elongation lower than 5%. In some cases, the first fiber include a polyethylene fiber, a liquid-crystal polymer fiber, an aramid fiber, a carbon fiber, a ceramic fiber, a metallic fiber, a glass fiber, and/or the like, and a combination thereof.

In some embodiments, the process 400 includes selecting second fibers (415). In some cases, the second fibers have a static elongation greater than 5%. In some cases, the second fiber comprises a nylon fiber, a composite fiber, a composite fiber comprising polyamide fiber, and a combination thereof. In some embodiments, the process 400 includes selecting third fibers (420). In some cases, the third fibers have a static elongation greater than 5%. In some cases, the third fibers are same as the second fibers. In some cases, the third fibers are different from the second fibers. In some cases, the third fiber comprises a nylon fiber, a composite fiber, a composite fiber comprising polyamide fiber, and a combination thereof.

In some embodiments, the process 400 includes twisting the first fibers into initial first fiber strands (425), for example, in a first twisting direction (e.g., S-direction). In some cases, the first fibers have a specification in the range of 420 Denier-1680 Denier. In some cases, the initial twist process uses a twist angle in the range of one-hundred and twenty (120) twist/meter to one-hundred and ninety (190) twist/meter. In some cases, the process 400 includes re-twisting the first fiber initial strands into first fiber strands (430), for example, in a direction opposite to the first twisting direction (e.g., Z-direction). In some cases, the re-twist process uses a twist angle in the range of eighty (80) twist/meter to one-hundred and forty 140 twist/meter.

In some embodiments, the process 400 includes twisting the second fibers into initial second fiber strands (435), for example, in a second twisting direction (e.g., Z-direction). In some cases, the second fibers have a specification in the range of 420 Denier-1680 Denier. In some cases, the initial twist process uses a twist angle in the range of one-hundred and twenty (120) twist/meter to one-hundred and ninety (190) twist/meter. In some cases, the process 400 includes re-twisting the initial second fiber strands into second fiber strands (440), for example, in a direction opposite to the second twisting direction (e.g., S-direction). In some cases, the re-twist process uses a twist angle in the range of eighty (80) twist/meter to one-hundred and forty 140 twist/meter.

In some embodiments, the process 400 includes twisting the third fibers into rope sheath strands (445). In one embodiment, the third fibers have a specification in the range of 5×420 Denier to 3×2000 Denier. In one embodiment, the twist process has a twist angle in the range of 80 twist/meter to 180 twist/meter.

In some embodiments, the process 400 includes conducting a first heat setting to the first fiber strands at a first temperature (450). In some cases, the first temperature is in the range of 70° C. to 180° C. In some cases, the first heat setting is conducted with a force applied. In one example, the force is 10% of the breaking strength of the first fiber strands, also referred to as first fiber cores. In some cases, the first heat setting lasts a first duration. In some cases, the first duration is in the range of five (5) minutes to ten (10) minutes.

In some embodiments, the process 400 includes conducting a second heat setting to the second fiber strands at a second temperature (455). In some cases, the second temperature is different from the first temperature. In some cases, the second temperature is in the range of 80° C. to 180° C. In some cases, the second heat setting lasts a second duration. In some cases, the second duration is different from the first duration. In some cases, the second duration is longer than the first duration. In some cases, the second duration is in the range of thirty (30) minutes to one-hundred and fifty (150) minutes.

In some embodiments, the process 400 includes conducting a third heat setting to the rope sheath strands (460). In some cases, the third heat setting is at a third temperature. In some cases, the third temperature is the same as the second temperature. In some cases, the third temperature is in the range of 80° C. to 180° C. In some cases, the third heat setting lasts a third duration. In some cases, the third duration is different from the first duration. In some cases, the third duration is longer than the first duration. In some cases, the third duration is in the range of thirty (30) minutes to one-hundred and fifty (150) minutes.

In some embodiments, the process 400 includes weaving the rope sheath strands into a rope sheath to form a rope (465), where the rope sheath encompasses the first fiber strands and the second fiber strands. In some cases, the process 400 includes weaving the rope sheath strands at a first pitch for a first section and weaving the rope sheath strands at a second pitch for a second section, and wherein the first pitch is different from the second pitch. In one example, the first pitch is in the range of twenty (20) millimeters to thirty-five (35) millimeters. In one example, the second pitch is in the range of twenty-eight (28) millimeters to forty (40) millimeters.

In some embodiments, the process 400 includes weaving the rope sheath strands comprises weaving the rope sheath in forty-knit, or referred to as forty-strand, plain weave. In some embodiments, the process 400 includes weaving the rope sheath in forty-knit twill weave. In some embodiments, the process 400 includes weaving the rope sheath in a combination of forty-knit plain weave and forty-knit twill weave. In some embodiments, the process 400 includes weaving the rope sheath strands comprises weaving the rope sheath in thirty-two-knit plain weave. In some embodiments, the process 400 includes weaving the rope sheath in thirty-two-knit twill weave. In some embodiments, the process 400 includes weaving the rope sheath in a combination of thirty-two-knit plain weave and thirty-two-knit twill weave. In some embodiments, the process 400 includes weaving the rope sheath strands comprises weaving the rope sheath in forty-eight-knit plain weave. In some embodiments, the process 400 includes weaving the rope sheath in forty-eight-knit twill weave. In some embodiments, the process 400 includes weaving the rope sheath in a combination of forty-eight-knit plain weave and forty-eight-knit twill weave.

EXAMPLES

Rope Example 1

The wear-resistant multifunctional rope disclosed in rope example 1 is manufactured or made in the following steps:

Step 1) Material selections: Select high strength low extensibility fibers (e.g., high molecular weight polyethylene fibers) as a first fibers for first rope core(s); and select high extensibility fibers (e.g., nylon fibers) as second fibers for second rope core(s) and rope sheath material.

Step 2) Rope sheath strand: Take second fibers, for example, having a specification of 420 Denier, and twist into rope sheath strands using the twist angle of 180 twists per meter.

Step 3) Rope core initial twist: Take first fibers and twist the fibers into first rope core initial strands using the twist angle of 190 twists per meter, in a first twist direction; and take nylon fibers, for example, having a specification of 420 Denier, and twist the fibers into second rope core initial strands using the twist angle of 190 twists per meter, in a second twist direction.

Step 4) Rope core re-twist: Take three (3) first rope core initial strands and twist the initial strands into first rope core strands using the twist angle of 140 twists per meter, in a twist direction opposite to the first twist direction; and take three (3) second rope core initial strands and twist the initial stands into second rope core strands using the twist angle of 140 twists per meter, in a twist direction opposite to the second twist direction.

Step 5) Formation: Heat the rope sheath strands of step 2) at 80° C. in continuous 150 minutes; heat the first rope core strands of step 4) at 70° C. in continuous 5 minutes with additional force applied; and heat the second rope core strands of step 4) at 80° C. in continuous 150 minutes. In one example, the additional force applied to the first rope core strands is about 10% of the breaking strength of the first rope core strands.

Step 6) Rope sheath: put the rope sheath strands on a weaving machine.

Step 7) Rope core: put the first rope core strands on a first winder of the weave machine; and put the second rope core strands on a second winder of the weave machine.

Step 8) Rope: Weave the rope sheath strands into a rope sheath encompassing the first rope core strands and the second rope core strands to form a rope. In some cases, the rope sheath has a first section of tighter weaving and a second section of regular weaving. In some cases, the weaving pitch is set to be 20 millimeters for the first rope sheath section, the weaving pitch is set to be 28 millimeters for the second rope sheath section. The first rope sheath section has better wear-resistant property. The second rope sheath section is softer and lighter.

Rope Example 2

The wear-resistant multifunctional rope disclosed in rope example 2 is manufactured or made in the following steps:

Step 1) Material selections: Select high strength low extensibility fibers (e.g., liquid-crystal polymer fibers) as first fibers for first rope core(s); and select high extensibility fibers (e.g., nylon fibers) as second fibers for second rope core(s) and rope sheath material.

Step 2) Rope sheath strand: Take second fibers, for example, having a specification of 2000 Denier, twist into rope sheath initial strands using the twist angle of 80 twists per meter, and re-twist into rope sheath initial strands.

Step 3) Rope core initial twist: Take first fibers and twist the fibers into first rope core initial strands using the twist angle of 120 twists per meter, in a first twist direction; and take nylon fibers, for example, having a specification of 1680 Denier, and twist the fibers into second rope core initial strands using the twist angle of 120 twists per meter, in a second twist direction.

Step 4) Rope core re-twist: Take three (3) first rope core initial strands and twist the initial strands into first rope core strands using the twist angle of 80 twists per meter, in a twist direction opposite to the first twist direction; and take three (3) second rope core initial strands and twist the initial stands into second rope core strands using the twist angle of 80 twists per meter, in a twist direction opposite to the second twist direction.

Step 5) Formation: Heat the rope sheath strands of step 2) at 180° C. in continuous 30 minutes; heat the first rope core strands of step 4) at 80° C. in continuous 10 minutes with additional force applied; and heat the second rope core strands of step 4) at 180° C. in continuous 30 minutes. In one example, the additional force applied to the first rope core strands is about 20% of the breaking strength of the first rope core strands.

Step 6) Rope sheath: put the rope sheath strands on a weaving machine.

Step 7) Rope core: put the first rope core strands on a first winder; and put the second rope core strands on a second winder.

Step 8) Rope: Weave the rope sheath strands into a rope sheath encompassing the first rope core strands and the second rope core strands to form a rope. In some cases, the rope sheath has a first section of tighter weaving and a second section of regular weaving. In some cases, the weaving pitch is set to be 35 millimeters for the first rope sheath section, the weaving pitch is set to be 40 millimeters for the second rope sheath section. The first rope sheath section has better wear-resistant property. The second rope sheath section is softer and lighter.

Various modifications and alterations of the disclosed embodiments will be apparent to those skilled in the art. The embodiments described are illustrative examples. The features of one disclosed example can also be applied to all other disclosed examples unless otherwise indicated. It should also be understood that all U.S. patents, patent application publications, and other patent and non-patent documents referred to herein are incorporated by reference, to the extent they do not contradict the foregoing disclosure.

What is claimed is:

1. A rope, comprising:

a set of first rope cores, each first rope core of the set of first rope cores comprising a first material;

a set of second rope cores, each second rope core of the set of second rope cores comprising a second material, the second material being different from the first material; and a rope sheath configured to encompass the set of first rope cores and the set of second rope cores, the rope sheath being braided from a plurality of rope sheath strands;

wherein the set of first rope cores are disposed approximate to a center of the rope;

wherein the set of second rope cores comprises two or more second rope cores distributed in an enclosed shape surrounding the first set of rope cores;

wherein each first rope core of the set of first rope cores comprises a plurality of first strands;

wherein each second rope core of the set of second rope cores comprises a plurality of second strands;

wherein each first rope core of the set of first rope cores has a first extensibility and each second rope core of the set of second rope cores has a second extensibility;

wherein the first extensibility is lower than the second extensibility.

2. The rope of claim 1, wherein the rope sheath is braided using at least thirty rope sheath strands.

3. The rope of claim 1, wherein the rope has a first state and a second state;

wherein the rope has a first static elongation rate in the first state;

wherein the rope has a second static elongation rate in the second state;

where the first static elongation rate is smaller than the second elongation rate.

4. The rope of claim 1, wherein the set of first rope cores has a breaking strength between seven kilonewtons and eleven kilonewtons.

5. The rope of claim 1, wherein the set of second rope cores has an extensibility of at least 50% at break.

6. The rope of claim 1, wherein the rope sheath comprises a first section of rope sheath and a second section of rope sheath, wherein the first section of rope sheath has a first weaving pitch, wherein the second section of rope sheath has a second weaving pitch different from the first weaving pitch.

7. The rope of claim 6, wherein the first weaving pitch is smaller than the second weaving pitch.

8. A rope, comprising:

a set of first rope cores, each first rope core of the set of first rope cores comprising a first material, a set of second rope cores, each second rope core of the set of second rope cores comprising a second material, the second material being different from the first material;

a rope sheath configured to encompass the set of first rope cores and the set of second rope cores; and a plurality of states comprising a first state and a second state;

wherein the rope has a first static elongation rate when the rope is in the first state, and wherein the rope has a second static elongation rate when the rope is in the second state, wherein the first elongation rate is lower than the second elongation rate, wherein none of the set of first rope cores is broken in the first state, wherein at least one first rope core of the set of first rope cores is broken in the second state, wherein none of the set of second rope cores is broken in the second state, wherein the set of first rope cores are disposed approximate to a center of the rope, wherein the set of second rope cores comprises two or more second rope cores distributed in an enclosed shape surrounding the first set of rope cores, wherein each first rope core of the set of first rope cores comprises a plurality of first strands, wherein each second rope core of the set of second rope cores comprises a plurality of second strands, wherein each first rope core of the set of first rope cores has a first extensibility and each second rope core of the set of second rope cores has a second extensibility, wherein the first extensibility is lower than the second extensibility.

9. The rope of claim 8, wherein the first static elongation rate is less than 2%.

10. The rope of claim 8, wherein the rope has an elongation rate at break less than 40% when the rope is in the first state.

11. The rope of claim 8, wherein the set of first rope cores has a breaking strength between seven kilonewtons and eleven kilonewtons.

12. The rope of claim 8, wherein the rope sheath comprises a first section of rope sheath and a second section of rope sheath, wherein the first section of rope sheath has a first weaving pitch, wherein the second section of rope sheath has a second weaving pitch different from the first weaving pitch.

13. The rope of claim 12, wherein the first weaving pitch is smaller than the second weaving pitch.

14. The rope of claim 8, wherein the rope sheath comprises a third material, wherein the third material has a higher extensibility than the first material.

* * * * *